US008659378B2

(12) United States Patent
Bonin et al.

(10) Patent No.: US 8,659,378 B2
(45) Date of Patent: Feb. 25, 2014

(54) ELECTRIC TRANSFORMER WITH IMPROVED COOLING SYSTEM

(75) Inventors: Massimo Bonin, Altavilla Vicentina (IT); Miljenko Hrkac, Monselice (IT)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/202,788

(22) PCT Filed: Mar. 12, 2009

(86) PCT No.: PCT/EP2009/052911

§ 371 (c)(1), (2), (4) Date: Nov. 4, 2011

(87) PCT Pub. No.: WO2010/102669

PCT Pub. Date: Sep. 16, 2010

(65) Prior Publication Data

US 2011/0309902 A1 Dec. 22, 2011

(51) Int. Cl.
*H01F 27/08* (2006.01)

(52) U.S. Cl.
USPC ..... 336/55

(58) Field of Classification Search
USPC ..... 336/55–62
See application file for complete search history.

(56) References Cited

U.S. PATENT DOCUMENTS

| | | | | | |
|---|---|---|---|---|---|
| 3,137,829 | A | * | 6/1964 | Dillow et al. | 336/57 |
| 3,371,299 | A | * | 2/1968 | Radkowski et al. | 336/57 |
| 3,663,910 | A | * | 5/1972 | Grubb | 336/57 |
| 5,267,393 | A | * | 12/1993 | Purohit et al. | 29/605 |
| 5,682,292 | A | | 10/1997 | Salanki | |
| 2006/0200971 | A1 | * | 9/2006 | Lanoue et al. | 29/602.1 |

FOREIGN PATENT DOCUMENTS

| | | | | |
|---|---|---|---|---|
| EP | 0616341 | A | | 9/1994 |
| GB | 1039818 | A | | 8/1966 |
| JP | 58204510 | A | * | 11/1983 |
| WO | 97/22980 | A | | 6/1997 |
| WO | 2006/069590 | | | 7/2006 |
| WO | 2009/052911 | | | 3/2009 |

* cited by examiner

*Primary Examiner* — Tuyen Nguyen
(74) *Attorney, Agent, or Firm* — Melissa J. Szczepanik

(57) ABSTRACT

An electric transformer comprising: a magnetic core; at least one coil assembly which is positioned around a portion of the magnetic core and comprises a plurality of windings; a structure adapted for applying a clamping force on the magnetic core and/or the windings; and a cooling circuit adapted for conveying cooling fluid directly inside the coil assembly.

12 Claims, 5 Drawing Sheets

ELECTRIC TRANSFORMER WITH IMPROVED COOLING SYSTEM

CROSS REFERENCE TO RELATED APPLICATION

This is a National Phase Application filed under 35 U.S.C. 371 of International Application No. PCT/EP2009/052911, filed on Mar. 12, 2009, the contents of which are relied upon and incorporated by reference in their entirety, and the benefit of priority under 35 U.S.C. 119 is hereby claimed.

BACKGROUND

The present invention relates to an electric transformer having an improved cooling system.

It is widely known in the art the use of electric induction devices, such as reactors or transformers, which exploit the electromagnetic induction for properly transmitting and distributing electricity over power lines.

In particular, the basic task of a power transformer is to allow exchanging electric energy between two or more electric systems of usually different voltages.

Most common power transformers generally comprise a magnetic core composed of one or more legs or limbs connected by yokes which together form one or more core windows; for each phase, around the legs there is arranged a coil which comprises a number of windings, usually indicated as low-voltage windings and high-voltage windings, or primary windings and secondary windings. It is also possible to have control or regulation windings.

The phase windings are realized by winding suitable conductors, for example wires, or cables, or strips, so as to achieve the desired number of turns; typical constructive configurations are for example the so-called multilayer or disc configurations, wherein the conductors are wound around a cylindrical tube which represents an optimal configuration as regard to filling the area available with useful material and providing also the maximum short circuit strength.

In particular, in the multi-layer winding technique, the conductor turns required for a coil are for example wound in one or more concentric conductor layers connected in series, with the turns of each conductor layer being wound side by side along the axial length of the coil until the conductor layer is full. A layer of insulation material is disposed between each pair of conductor layers. Axially-extending cooling ducts may also be formed between pairs of conductor layers. In U.S. Pat. No. 7,023,312, pre-formed cooling ducts are inserted between conductor layers during the winding of a coil.

In the disc winding technique, the conductor turns required for a coil are for instance wound in a plurality of discs serially disposed along the axial length of the coil; in each disc, the turns are wound in a radial direction, one on top of the other, i.e., one turn per layer. The discs are usually connected in a series circuit relation and are typically wound alternately from inside to outside and from outside to inside so that the discs can be formed from the same conductor. An example of such alternate winding is shown in U.S. Pat. No. 5,167,063.

Due to the intrinsic structural characteristics and functioning of these devices, the various components of the transformers, and in particular the active electromagnetic parts such as the windings, are subject to overheating; hence, a very important aspect for ensuring the proper functioning of transformers concerns the systems adopted for cooling the active electromagnetic parts of the transformers, and in particular the phase windings. Indeed, an excess of temperature may damage the windings, and in particular the insulating elements thereof, thus resulting in mechanical/electrical losses and adversely affecting the overall performances of the transformer.

To this end, at the present state of the known art and according to a widely used solution, the magnetic core and the various coils are immersed into a cooling fluid, typically a mineral oil, which is contained inside a transformer tank. One or more external radiators are provided at one or more sides of the transformer tank; due to natural convection, the cooling fluid flows into the radiators, exchanges heat with open air and then returns inside the tank at a lowered temperature. Sometimes, the circulation of the cooling fluid inside the tank is facilitated by using a pump.

Although this cooling solution works properly, it would be desirable to provide an electric transformer which has a further improved cooling system. The present invention is directed to such a transformer.

SUMMARY

In accordance with the present invention, there is provided an electric transformer comprising a magnetic core, at least one coil assembly which is positioned around a portion of said magnetic core and comprises a plurality of windings, a structure adapted for applying a clamping force on said magnetic core and/or windings, said clamping structure comprising at least a first clamping bar, and a cooling circuit adapted for conveying cooling fluid directly inside said at least one coil assembly.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
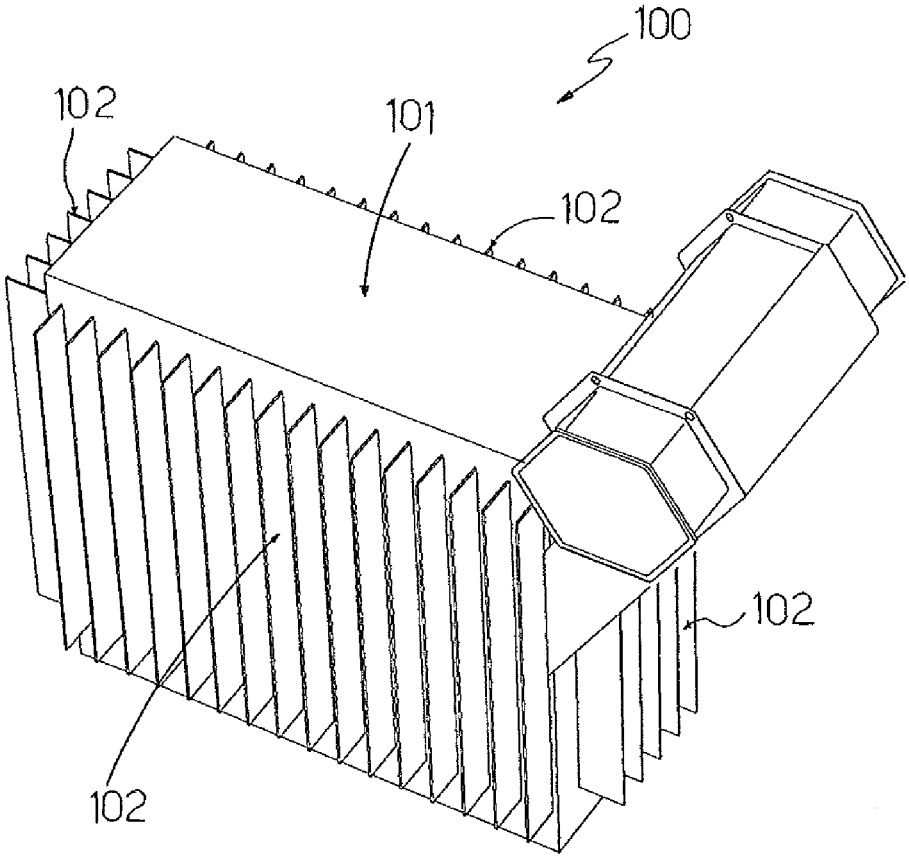
FIG. 1 is a perspective view showing an example of a power transformer.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

FIG. 1 shows an exemplary embodiment of an electric transformer indicated by the reference numeral 100; the transformer 100 comprises a tank 101 containing an insulating fluid, e.g. a mineral or vegetal oil, inside which there are immersed for cooling purposes some electromagnetic components of the transformer, namely the assembly constituted by a magnetic core and the phase windings. A plurality of radiator elements 102 is provided at one or more sides of the tank 101; the radiator elements 102, which may be variously shaped according to many constructive layouts, constitute the usual cooling system widely used in electric transformers, according to solutions well known in the art and therefore not described in details hereinafter.

Figure 2:
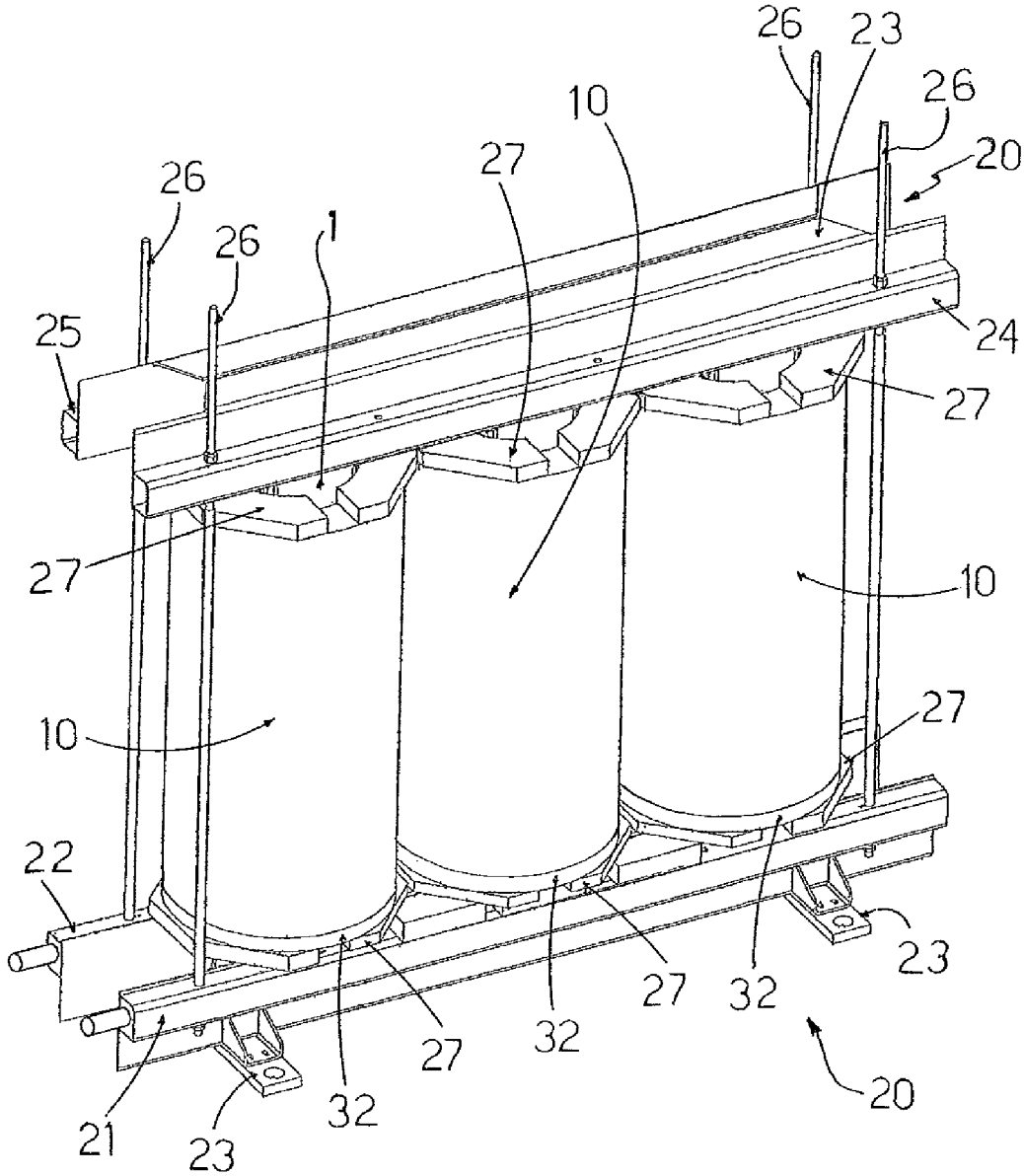
FIG. 2 is a perspective view showing some components of a three-phase power transformer according to the invention.
Figure 3:
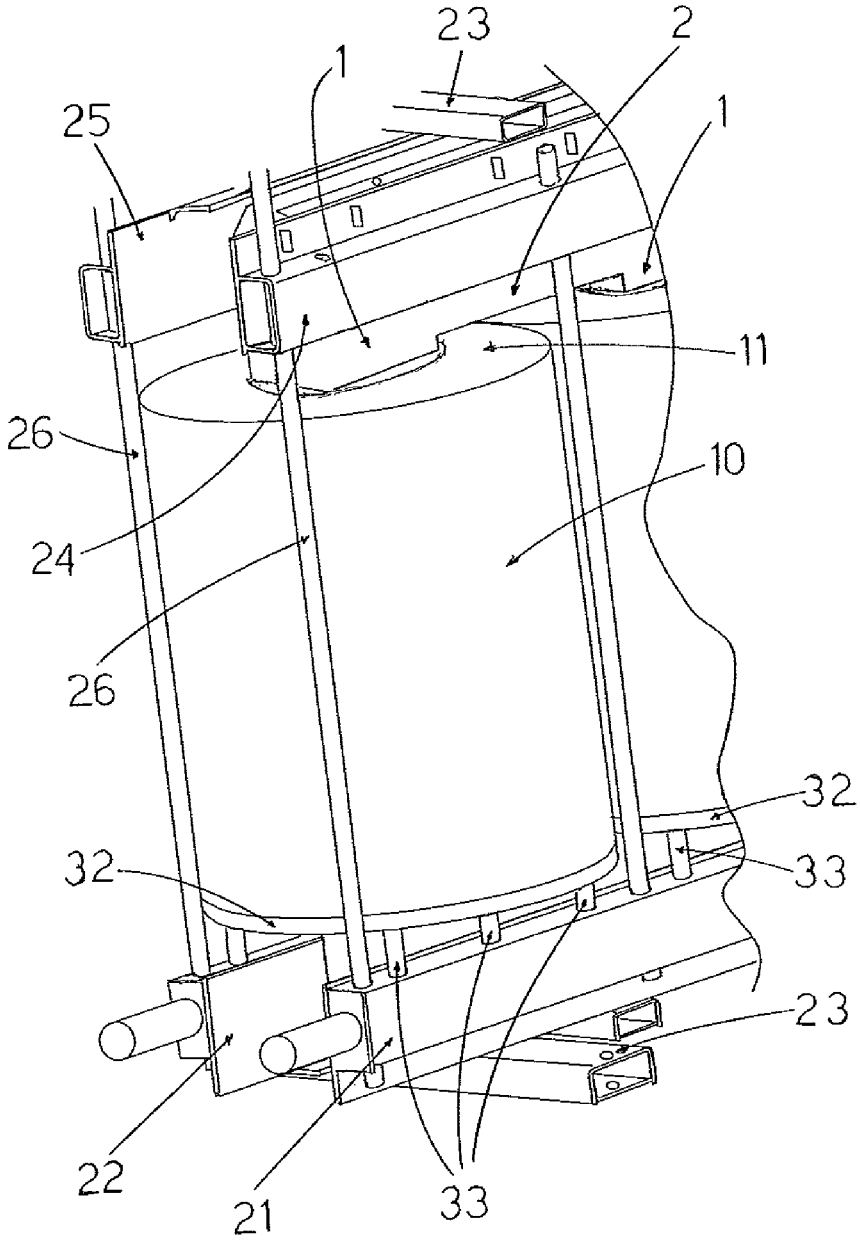
FIG. 3 is a perspective view showing in more details a portion of the transformer of FIG. 2.

FIGS. 2-3 show a possible embodiment of the components of the transformer 100 which are positioned inside the tank 101, wherein in FIG. 3 some components illustrated in FIG. 2 have been omitted for the sake of viewing more clearly some parts of the transformer 100.

As illustrated, the transformer 100 comprises a magnetic core which has at least one leg 1; in the embodiment of FIG. 2, the magnetic core comprises one leg 1 for each phase, namely three, with the legs 1 mutually connected by yokes 2 (partially visible in FIG. 3) according to constructive configurations which are also well known in the art and therefore will not be described herein in details.

Although the transformer 100 is shown and described as being a three-phase transformer, it should be appreciated that the present invention is not limited to three-phase transformers.

As shown in FIGS. 2-3, at least one coil assembly indicated by the reference numeral 10 is positioned around a portion of the magnetic core, preferably around a leg 1; in particular, there is provided a coil assembly 10 for each phase of the transformer 100—i.e. in the embodiment illustrated in the attached figures there are provided three coil assemblies 10.

Figure 4:
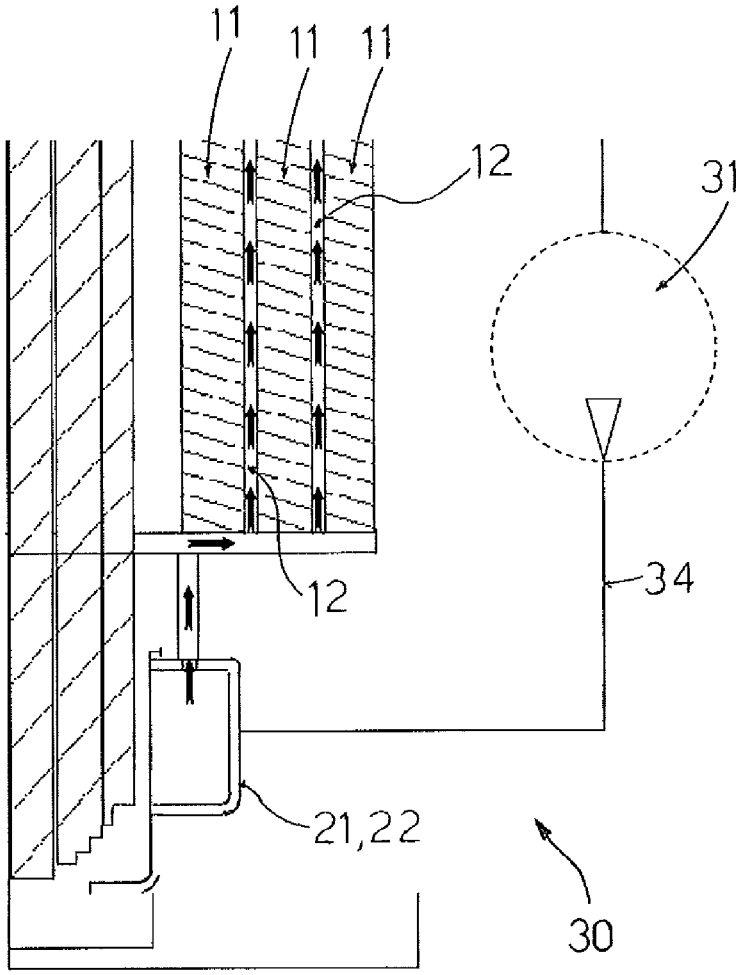
FIGS. 4-5 are schematic views illustrating a cooling system of the electric transformer according to the invention used in coil assemblies with windings realized according to a multi-layer configuration and a disc configuration, respectively.

Each coil assembly 10 is positioned around an associated portion of the magnetic core, e.g. a corresponding leg 1, and comprises a plurality of windings 11, such as an inner winding which has a first rated voltage, and an outer winding which is arranged around the inner winding and has a second rated voltage different from the first rated voltage. According to solutions well known in the art, the windings 11 are built by winding a suitable conductor, for instance a copper or aluminum sheet, around a tubular element in such a way that each coil assembly 10 has a whole cylindrical configuration, as illustrated in the figures. As known, the conductor forms a plurality of turns and can be wound according to a multilayer technique, as schematically represented in FIG. 4, or according to a disc-like configuration schematically illustrated in FIG. 5. Further, the windings 11 can be arranged concentrically to each other, i.e. as previously mentioned one internal to the other, or can be axially displaced along the associated portion of the magnetic core, i.e. one above the other.

Each coil assembly 10 further comprises a plurality of cooling ducts 12 which are provided at various positions between adjacent turns.

As illustrated in more details in FIG. 2, the transformer 100 comprises a structure or frame, globally indicated by the reference numeral 20, which is adapted for applying a clamping force on the magnetic core and/or the windings 11 of the coil assemblies 10. The clamping structure or frame 20 has the task of maintaining the magnetic core and the coil assemblies 10 in the proper position for which they are designed and for enabling them to more effectively resist the forces developed during shipment, installation and operation of the transformer.

The clamping structure 20 comprises at least a first clamping bar 21; preferably, in the embodiment illustrated, the clamping structure 20 comprises a first clamping bar 21 and a second clamping bar 22 which are positioned at one end, i.e. the lower end, of the coil assemblies 10, and are connected to each other by means of one or more connecting elements 23. In the embodiment illustrated these connecting elements are represented by transverse plates 23; alternatively it is possible to use different elements, for instance tie-rods, or any other suitable element.

Further, the illustrated clamping structure 20 comprises a third clamping bar 24 and a fourth clamping bar 25 which are positioned at a second end, i.e. the upper end, of the coil assemblies 10 and are connected to each other by means of one or more connecting elements 23, such as transverse plates 23, tie-rods, or equivalent elements.

The four clamping bars 21, 22, 24, 25, which can be also indicated with equivalent terms, such as core clamps, are formed by suitably shaped pieces of metal and extend along the series of coil assemblies 10 which are positioned side-by side; in addition the first bar 21 and the third bar 24, and the second bar 22 and the fourth bar 25, respectively, are connected to each other by means of one or more connecting elements 26, typically tie-rods, which—once mechanically tied—allow exercising a clamping force on the assembly magnetic core-coil assemblies 10. Between the bars 21, 22, 24 and 25 and the coil assemblies 10 there may be provided some elements 27, e.g. the so called winding tables, made for example of wood.

Advantageously, in the electric transformer 100 according to the invention, in addition to the traditional cooling radiators 102, there is provided a purposive cooling circuit 30 which is adapted for conveying a cooling fluid, such as a mineral or vegetal oil directly inside at least one coil assembly 10; preferably, the cooling circuit 30 according to the invention is adapted for conveying the cooling fluid directly inside one or more of the cooling ducts 12 of a coil assembly 10.

Preferably, the cooling circuit 30 is adapted for conveying the cooling fluid directly inside each coil assembly 10, more preferably for conveying the cooling fluid inside one or more cooling ducts 12 of each coil assembly 10.

According to a particularly preferred embodiment, the first clamping bar 21 is part of the cooling circuit 30 and is adapted for allowing flowing of the cooling fluid towards at least one coil assembly 10, more preferably for allowing flowing of the cooling fluid towards each coil assembly 10.

To this end, the clamping bar 21 is suitably shaped, e.g. it has a closed channel-like body, adapted to allow passage of the cooling fluid inside it substantially without leaks; at it will be described in more details hereinafter, the body of the clamp bar 21 has one or more inlets and outlets at the desired position in order to allow the cooling fluid flowing into and out from it.

In particular, the first clamping bar 21 is in fluid communication with the internal part of at least one coil assembly 10; preferably the first clamping bar 21 is in fluid communication with one or more cooling ducts 12 of a coil assembly 10; more preferably the first clamping bar 21 is in fluid communication with each coil assembly 10, and more particularly with one or more cooling ducts 12 of each coil assembly 10.

As schematically illustrated in FIG. 4, the cooling circuit 30 comprises a pump 31 for pumping the cooling fluid from a fluid container into the first clamping bar 21. The pump can be connected to the first clamping bar 21 directly or through a conductor 34.

Preferably the cooling fluid used by the circuit 30 is that contained into the tank 101; alternatively it is possible to contain the fluid used by the circuit 30 into a different container.

In addition, the cooling circuit 30 according to the invention comprises a first fluid diffuser 32 which is operatively connected to one of the coil assemblies 10, and one or more pipes 33 which protrude transversely from the first clamping bar 21 and are connected to the first fluid diffuser 32.

Preferably, the cooling circuit 30 comprises a plurality of fluid diffusers 32 each of which is operatively connected to an associated coil assembly 10 and is adapted for allowing flowing of the cooling fluid into one or more cooling ducts 12 of the associated coil assembly 10; each fluid diffuser 32 is connected to the first clamping bar 21 by means of one or more pipes 33 protruding transversely from the first clamping bar 21.

Each diffuser 32 comprises a body which can be shaped according to the applications; in the example illustrated in the attached figures, the diffuser 32 has a ring-shaped body and is operatively connected at one end of the associated coil assembly 10; the ring shaped body can be completely open at the upper part, i.e. it is configured as a lid which is attached at one end of the coil assembly 10, or it can be closed at the upper part and provided with openings at the inlets of the cooling ducts 12 of the associated coil assembly 10.

Advantageously, in the electric transformer 100 according to the invention, also the second clamping bar 22 is part of the cooling circuit 30 and is adapted for allowing flowing of the cooling fluid towards one or more of the coil assemblies 10, preferably for allowing flowing of the cooling fluid towards all coil assemblies 10. Preferably, also the second clamping bar 22 is operatively coupled to the pump 31, has a shaped body equal to or very similar to that of the first clamping bar 21, and is in fluid communication with the internal part of one or more of the plurality of coil assemblies 10. Alternatively it is possible to use another pump operatively connected to the second clamping bar 22 which pumps fluid from inside the tank 102 or from another different fluid container.

Preferably the second clamping bar 22 is in fluid communication with each coil assembly 10; more preferably, the second clamping bar is in fluid communication with one or more cooling ducts of each coil 30; in particular, the second clamping bar 22 is connected to each fluid diffuser 32 by means of one or more pipes 33 which protrude transversely from the second clamping bar 22 itself.

Figure 5:
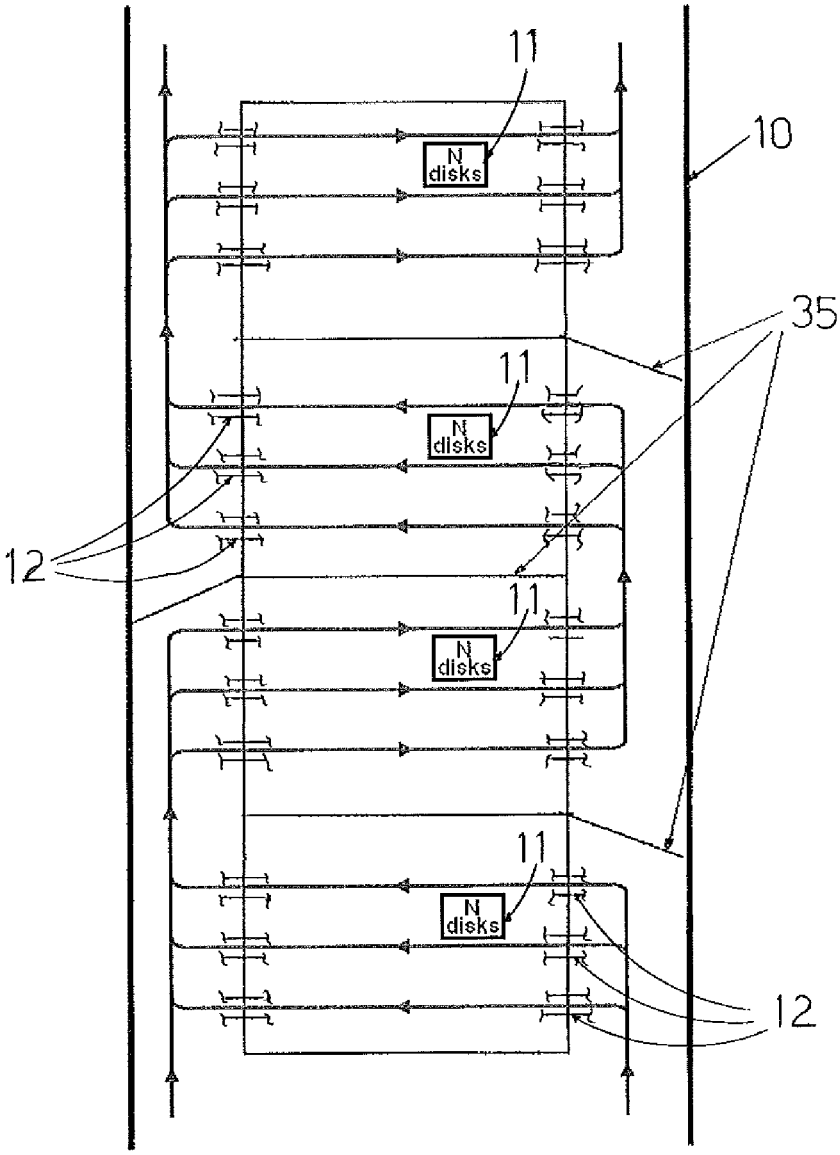

Finally, as schematically illustrated in FIG. 5, inside one or more of the coil assemblies 10 there might be provided one or more guide elements 35; the guide elements 35 are positioned inside an associated coil assembly 10 and have a shaped body which adapted for guiding the cooling fluid into the cooling ducts 12. For example, the guide element 35 can be formed by planar plates having two sections positioned in such a way to properly deflect the cooling fluid inside the cooling ducts 12.

In practice, it has been found that the electric transformer according to the invention gives some significant advantages and improvements with respect to known electric transformers. Indeed, thanks to the presence of the described cooling circuit which forcedly conveys cooling fluid directly inside the coil assemblies and in particular directly inside the various cooling ducts, the overall cooling of the transformer is improved with respect to known types of transformers using conventional cooling means such as radiators. It is to be noted that such improvements are achieved by exploiting some components already existing in known transformers such as the clamping bars, and can be used in different type of coil windings configurations.

Thanks to the overall improved cooling system, it follows that the transformer of the present invention has improved performances when compared to known devices of the same size and characteristics or it can provide the same performances with reduced sizes and therefore at a reduced cost.

The electric transformer thus conceived is susceptible of numerous modifications and variations, all of which are within the scope of the inventive concept as defined in the appended claims; for example, one or more components such as the clamping bars or the diffusers, or the guide elements can be differently shaped or positioned. Finally, all the details may furthermore be replaced with other technically equivalent elements, and the materials and dimensions may be any according to requirements and to the state of the art, provided they are compatible with the scope of and functioning in the application.

What is claimed is:

1. An electric transformer, comprising:

a magnetic core;

at least one coil assembly which is positioned around a portion of said magnetic core and comprises a plurality of windings, said coil assembly further comprising a plurality of cooling ducts provided at various positions between adjacent turns of said coil assembly;

a structure adapted for applying a clamping force on said magnetic core and/or windings, said clamping structure comprising at least a first clamping bar; and a cooling circuit comprised of:

said first clamping bar;

one or more pipes which protrude transversely from said first clamping bar; and a first fluid diffuser having a ring-shaped body with first and second ends, said first end connected to said at least one coil assembly and said second end connected to said one or more pipes, said cooling circuit adapted for allowing cooling fluid to flow through said first clamping bar, said one or more pipes and said first fluid diffuser towards and inside said at least one coil assembly and one or more of said cooling ducts.

2. The electric transformer according to claim 1 wherein said first clamping bar is in fluid communication with the internal part of said at least one coil assembly.

3. The electric transformer according to claim 1 wherein said cooling circuit comprises a pump for pumping cooling fluid from a fluid container into said first clamping bar.

4. The electric transformer according to claim 1, further comprising one or more guide elements which are positioned inside said at least one coil assembly and are adapted for guiding said cooling fluid into said cooling ducts.

5. The electric transformer according to claim 1, further comprising a plurality of coil assemblies, each of said coil assemblies comprising a plurality of windings and being positioned around a corresponding portion of said magnetic core, wherein said cooling circuit is adapted for conveying cooling fluid directly inside each of said plurality of coil assemblies.

6. The electric transformer according to claim 5 wherein each of said coil assemblies comprises a plurality of cooling ducts and said cooling circuit is adapted for conveying cooling fluid directly inside one or more cooling ducts of each coil assembly.

7. The electric transformer according to claim 5 wherein said first clamping bar is in fluid communication with the internal part of each coil assembly of said plurality of coil assemblies.

8. The electric transformer according to claim 6 wherein said cooling circuit comprises a plurality of fluid diffusers each of which is operatively connected to an associated coil assembly of said plurality of coil assemblies and is adapted for allowing flowing of the cooling fluid into the cooling ducts of the associated coil assembly.

9. The electric transformer according to claim 8 wherein each fluid diffuser of said plurality of diffusers is connected to said first clamping bar by means of one or more pipes protruding transversely from the first clamping bar.

10. The electric transformer according to claim 1, wherein said clamping structure comprises a second clamping bar which is part of said cooling circuit and is adapted for allowing flowing of said cooling fluid towards one or more of said coil assemblies.

11. The electric transformer according to claim 10 wherein said second clamping bar is operatively coupled to a pump, said pump for pumping cooling fluid from a fluid container, said second clamping bar is in fluid communication with the internal part of one or more of said plurality of coil assemblies.

12. The electric transformer according to claim 8 wherein each fluid diffuser of said plurality of diffusers is connected to a second clamping bar by means of one or more pipes protruding transversely from said second clamping bar.

* * * * *